United States Patent [19]

Kern et al.

[11] Patent Number: 4,586,566

[45] Date of Patent: May 6, 1986

[54] ARRANGEMENT FOR JOINING THE TUBES OF A HEAT EXCHANGER CORE WITH A CONNECTING BOX PARTICULARLY FOR EVAPORATORS

[75] Inventors: Josef Kern; Helmut Bardong, both of Stuttgart; Bohumil Humpolik, Ludwigsburg; Karl-Heinz Staffa, Stuttgart, all of Fed. Rep. of Germany

[73] Assignee: Sueddeutsche Kuehlerfabrik Julius Fr. Behr GmbH & Co. KG, Stuttgart-Feuerbach, Fed. Rep. of Germany

[21] Appl. No.: 408,907

[22] Filed: Aug. 17, 1982

[30] Foreign Application Priority Data

Aug. 26, 1981 [DE] Fed. Rep. of Germany ..... 3133665

[51] Int. Cl.[4] ..... F28F 9/04; F28F 9/16; F28D 7/06

[52] U.S. Cl. ..... 165/173; 165/176; 165/79; 165/905; 156/258; 156/304.5; 29/157.4; 62/515; 62/525

[58] Field of Search ..... 165/172, DIG. 8, 173, 165/176, 79, 153; 156/258, 304.5; 29/157.4; 62/515, 525

[56] References Cited

U.S. PATENT DOCUMENTS

| | | | |
|---|---|---|---|
| 1,181,856 | 5/1916 | Downer . | |
| 2,453,391 | 11/1948 | Whittingham . | |
| 2,468,924 | 5/1949 | Courtier . | |
| 3,205,940 | 9/1965 | Carns | 165/176 |
| 3,985,169 | 10/1976 | Chow | 156/258 |
| 3,993,126 | 11/1976 | Taylor | 165/79 |
| 4,244,194 | 1/1981 | Haesters et al. | 165/173 |
| 4,266,604 | 5/1981 | Sumikawa et al. | 165/176 |
| 4,430,868 | 2/1984 | Kern et al. | 62/525 |

FOREIGN PATENT DOCUMENTS

| | | | |
|---|---|---|---|
| 604705 | 10/1934 | Fed. Rep. of Germany . | |
| 665593 | 9/1939 | Fed. Rep. of Germany . | |
| 1205564 | 11/1965 | Fed. Rep. of Germany . | |
| 2036398 | 2/1971 | Fed. Rep. of Germany | 165/173 |
| 2300881 | 9/1973 | Fed. Rep. of Germany | 165/176 |
| 2728827 | 5/1979 | Fed. Rep. of Germany . | |
| 338477 | 7/1959 | Switzerland . | |
| 1232414 | 5/1971 | United Kingdom | 165/153 |

*Primary Examiner*—William R. Cline
*Assistant Examiner*—John K. Ford
*Attorney, Agent, or Firm*—Schwartz, Jeffery, Schwaab, Mack, Blumenthal & Evans

[57] ABSTRACT

An arrangement is disclosed for joining the tubes of a heat exchanger core to a connecting box, wherein the tubes are fastened to the connecting box and sealed, said tubes being secured to the connecting box by means of a friction joint and at least one space being provided for each tube surrounding the end of the tube; each said space comprising a cavity bounded by the connecting box and the tube or a corresponding recess, and being filled and sealed with adhesive material.

1 Claim, 18 Drawing Figures

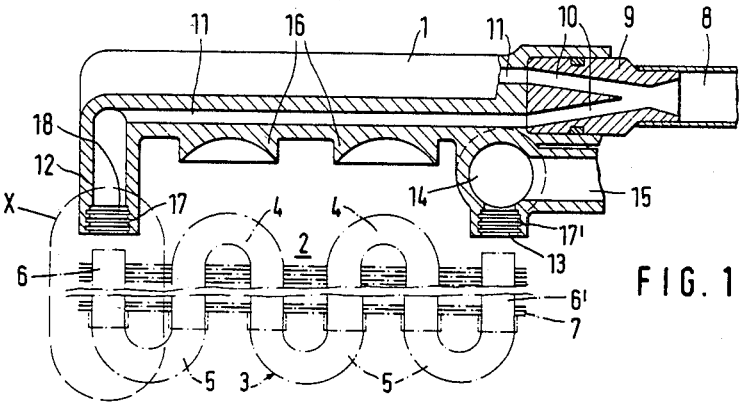
FIG. 1
FIG. 2
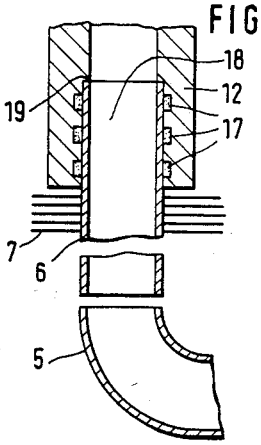
FIG. 3
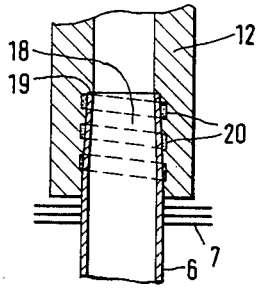
FIG. 4
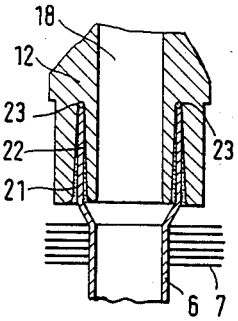
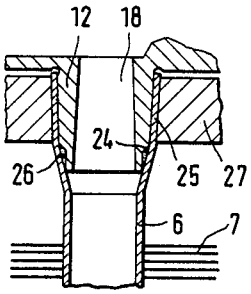
FIG. 5
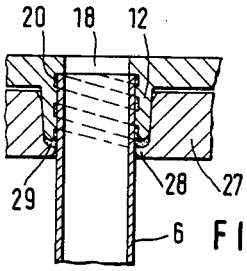
FIG. 6

FIG. 10
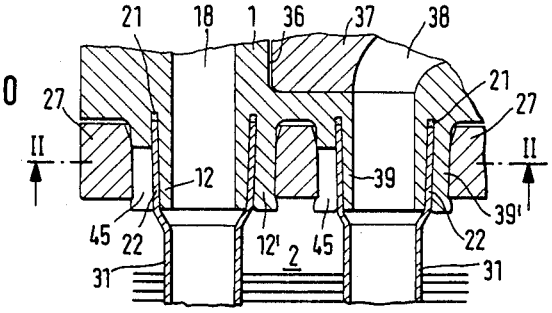
FIG. 11
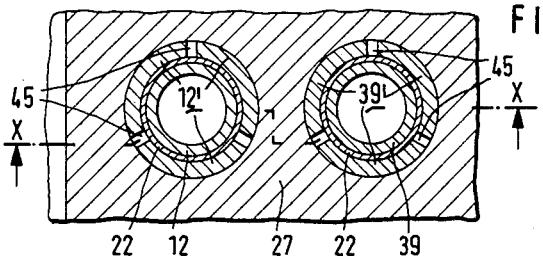
FIG. 12
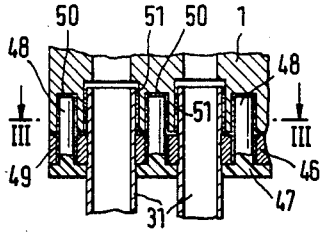
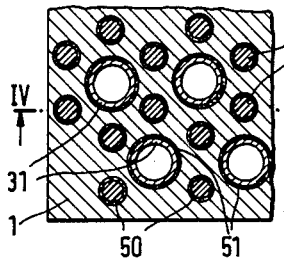
FIG. 13
FIG. 14
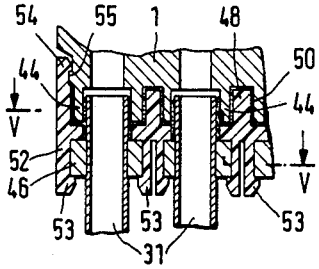
FIG. 15
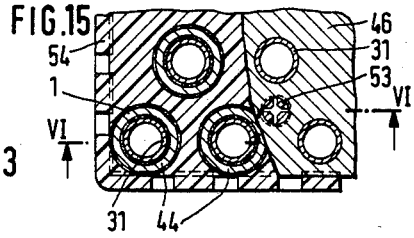

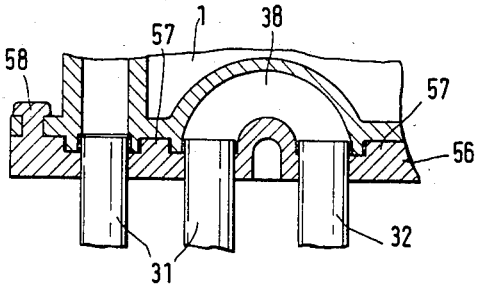
FIG. 16
FIG. 17
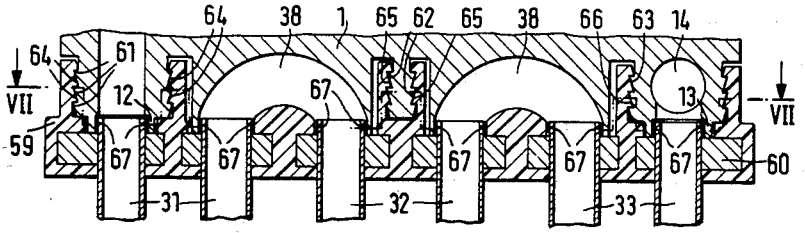
FIG. 18
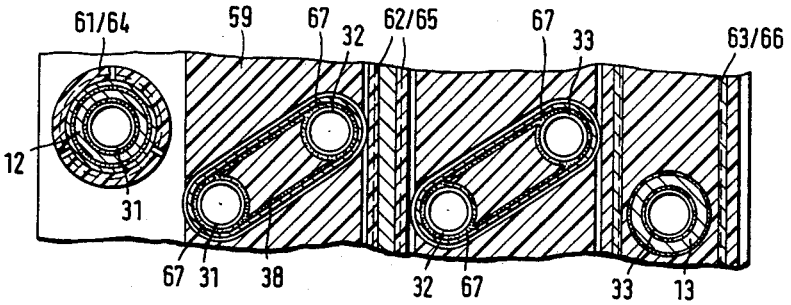

ARRANGEMENT FOR JOINING THE TUBES OF A HEAT EXCHANGER CORE WITH A CONNECTING BOX PARTICULARLY FOR EVAPORATORS

BACKGROUND OF THE INVENTION

The present invention relates to an arrangement for joining the tubes of a heat exchanger core with a connecting box to which the tubes are fastened and sealed.

A heat exchanger operating as an evaporator is disclosed in German Auslegeschrift No. 27 28 827. The heat exchanger consists of a heat exchanger core constructed in a ribbed tube configuration and a connecting box formed of synthetic resin material. The connecting box comprises a distributor chamber and a collector chamber, with the beginning of each evaporator tube opening in the distributor chamber and the end in the collector chamber. The connecting box has a plurality of connecting fittings, each surrounded by an annular groove. The annular grooves are filled with a hardenable synthetic resin and subsequently the tubes are fitted over the connecting fittings so that their ends rest in the annular grooves. The hardenable synthetic resin effects both mechanical attachment and the sealing of the arrangement. As a result of this dual function of the hardenable resin, especially in the case of high pressure and temperature fluctuations such as occur during the operation of the evaporator in motor vehicle air conditioners, the demands for durability of the layer of the synthetic resin are very high.

SUMMARY OF THE INVENTION

Accordingly it is an object of the present invention to provide an improved arrangement for joining the tubes of a heat exchanger core to a connecting box.

Another object of the invention is to provide an arrangement for joining the tubes of a heat exchanger core to a connecting box in which a strong mechanical attachment of the tubes to the connecting box wall capable of resisting mechanical stress is provided.

A further object of the present invention is to provide an arrangement for joining the tubes of a heat exchanger core to a connecting box in which a secure, tight seal between the tubes and the connecting box is provided.

It is also an object of the present invention to provide an arrangement for joining the tubes of a heat exchanger core to a connecting box which is durable and extremely reliable.

These and other objects of the invention are achieved by providing an arrangement for joining the tubes of a heat exchanger core to a connecting box wherein the tubes are frictionally attached to the connecting box and for each tube at least one space surrounding the end of the tube is provided filled with adhesive, said space comprising a cavity bounded by the connecting box and the tube or a corresponding recess.

BRIEF DESCRIPTION OF THE DRAWINGS

The invention will be explained in further detail with reference to the accompanying drawings wherein:

FIG. 1 is a cross-sectional view through a connecting box with a schematically depicted evaporator core;

FIG. 2 is an enlarged representation of the detail X of FIG. 1;

FIG. 3 is an enlarged representation showing an alternate embodiment having a connecting fitting with a conical or tapered opening;

FIG. 4 is an enlarged representation of another alternate embodiment with a conically narrowing annular slot surrounding the connecting box opening;

FIG. 5 illustrates a mode of fastening a tube to a connecting box with a clamping plate;

FIG. 6 shows an alternate embodiment similar to the device of FIG. 5;

FIG. 10 illustrates an arrangement similar to the embodiment of FIG. 4 additionally provided with a clamping plate;

FIG. 11 is a sectional view taken along line II—II of FIG. 10;

FIG. 12 shows a tube/bottom plate joint for a connecting box with a two-part bottom;

FIG. 13 is a sectional view taken along line III—III of FIG. 12;

FIG. 14 is an alternate embodiment of a tube/bottom plate joint for a connecting box;

FIG. 15 is a sectional view taken along line V—V of FIG. 14;

FIG. 16 depicts a simplified embodiment of a tube/-bottom plate joint for a connecting box;

FIG. 17 illustrates a further embodiment of a tube/-bottom plate joint for a connecting box with additional locks on the distributor and the bottom; and FIG. 18 is a sectional view taken along line VII—VII of FIG. 17.

DETAILED DESCRIPTION OF PREFERRED EMBODIMENTS

Figure 7:
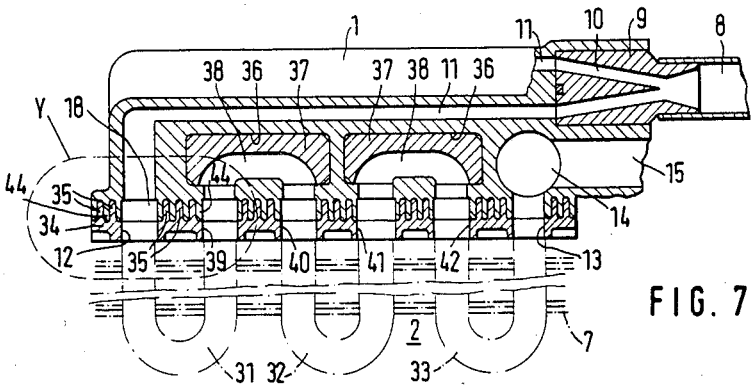
FIG. 7 is a cross-sectional view of a connecting box comprising a distributor and a bottom with integrated reversing channels and a schematically depicted evaporator core.

By means of the arrangement of the invention, a frictional joint is produced between the tube and the part of the connecting box which receives the tube, the joint being capable of withstanding the mechanical forces encountered. In order to obtain the necessary coolant tightness in the case of evaporators, cavities are provided surrounding the tube ends and filled with an adhesive material. Any adhesive used will primarily have a sealing function. Numerous configurations and dimensions are suitable for the cavities which receive the adhesive. Suitable adhesives include epoxy resin with hardness.

The connecting box is equipped with connecting fittings to receive the tube ends. The fittings may be provided with a conical or tapered opening into which the tube ends are pushed. In this manner, a satisfactory press fit is automatically obtained upon the insertion of the tube into the opening. If the connecting fittings have cylindrical openings, the press fit may be produced by flaring or expanding the tube ends. In the case of projecting connecting fittings, the tube is preferably placed on the outer circumference of the connecting fitting and fastened by means of a clamping plate. A clamping plate of this type has the advantage that a plurality of tube connections may be effected simultaneously with a single tool. A further possibility for effecting the frictional joint is to clamp the tubes into annular grooves surrounding the connecting fittings. To provide the necessary sealing, the grooves are filled with an adhesive. If very high mechanical stresses are to be expected, it is advantageous to provide the parts of the connecting fittings located radially outside the tube with a plurality of slits distributed around the circumference and to force a clamping plate onto these parts of the connecting fittings. The slits serve to facilitate plastic deformation of the outer parts of the connecting fittings. Numerous configurations are possible for the cavitites which receive the adhesive. They may, for example, take the form of an adhesive pocket, a helical flute, a step on the connecting fitting or a shoulder or flange on the clamping plate.

If the connecting box is equipped with integrated reversing channels, it is advantageous to provide the connecting box with a bottom to which the tubes are fastened. The connecting box and the bottom may be joined by means of an adhesive. It is also possible to provide a positive acting fastening device. In order to obtain a large adhesive surface and to seal the individual tube joints from each other with absolute security, the bottom is provided with a plurality of projections, which annularly surround each tube end or each opening and engage recesses in the connecting box, whereby a plurality of tongue and groove conections are formed in the area of the joint between the connecting box and the bottom. If the bottom and the connecting box have flange-like joining surfaces, it is advisable to additionally fasten the bottom plate to the periphery of the connecting box with rivets. Especially if it is expected that the flaring of the tube in the bottom will produce a large frictional joint, it is recommended to provide the bottom in two parts, with one of the parts being a metal plate, preferably an aluminum plate, and the other part being formed of synthetic resin. The metal plate may be embedded in the synthetic resin part or be connected to the latter by snap-on elements. It is also possible to clamp the metal plate between the synthetic resin part and the connecting box. As positive acting connectors between the bottom and the connecting box, a plurality of catches or spring locks may be used. The synthetic resin parts may suitably be formed of polyamid.

Turning now to the drawings, FIG. 1 shows a connecting box 1 and an evaporator core 2 of an evaporator. The evaporator core 2 comprises several evaporator tubes 3, connected in parallel with respect to each other, with each of the evaporator tubes 3 comprising several fork tubes 4, tube bends 5 and straight tube pieces 6. The evaporator core 2 further comprises a plurality of ribs 7, extending transversely to the fork tubes 4 and the straight tube pieces 6. The straight pieces 6 form the beginning and the end of each evaporator tube 3, which is fastened to the connecting box 1.

The connecting box 1 has a coolant inlet 8 connected to the inlet side of a venturi distributor 9. The venturi distributor 9 has several outlet channels 10, with one outlet channel 10 being provided for each evaporator tube 3. The outlet channels 10 open into the channels 11, which each lead to an opening 18 in a connecting fitting 12. Each of the connecting fittings 12 receives a straight tube piece 6 of an evaporator tube 3. The straight tube pieces 6', which form the ends of the evaporator tubes 3, are received in tube fittings 13, which open into a common collecting chamber 14 in the connecting box 1. A compressor suction line 15 is connected to the collecting chamber 14.

Connecting box 1 is provided with supporting elements 16 on its side facing the evaporator core 2. The configuration of the supporting elements is adapted to the curvature of the fork tubes 4. Supporting elements 16 serve to hold the fork tubes 4 during the manufacture of the evaporator core 2. Adhesive pockets 17 are provided in the connecting fittings 12, and adhesive pockets 17' are provided in the connecting fittings 13.

To manufacture the heat exchanger core 2, the ribs 7 are initially tacked on the fork tubes 4 and the straight tube pieces 6 and 6'. The heat exchanger core 2 is then placed adjacent the connector box 1, in such a way that the fork tubes 4 are adjacent the supporting elements 16 and the straight tube piece 6 is inserted into connecting fitting 12 while the straight tube piece 6' is inserted into the connecting fitting 13. Fork tubes 4 and straight tube pieces 6 and 6' are subsequently spread or flared in the well-known manner in order to obtain good thermal conduction between the evaporator tubes 3 and the ribs 7. To fasten the straight tube pieces 6 and 6' in the connector fittings 12 and 13, the tube is likewise expanded or flared inside the connecting fittings by means of a mandrel, so that a strong press fit between the connecting fitting and the tube is obtained. The adhesive applied to the tube ends or to the connecting fittings prior to the introduction of the straight tube pieces 6 and 6' into the connecting fittings 12 and 13, collects in the adhesive pockets 17, 17' and hardens therein. After the evaporator core 2 has been solidly joined to the connecting box 1, the tube bends 5 are placed onto the free ends of the straight tube pieces 6 and 6' and the fork tubes 4 and soldered together or joined by some other process.

FIG. 2 is an enlarged detail view of the area X of FIG. 1. It can be seen that straight tube piece 6 is inserted into an enlarged part of the opening 18 in connecting fitting 12 and rests against a projection 19 which serves as a stop. The diameter of the part of the opening 18 in connecting fitting 12 that is not enlarged, corresponds to the internal diameter of the straight tube piece 6 after flaring. The adhesive is located in the adhesive pockets 17.

FIG. 3 shows a connecting fitting 12 with an opening 18 which is conically expanded in the outward direction. In the area of the conical expansion there is a helical furrow 20 on the wall of the opening which serves to receive the adhesive. The conical part of the bore 18 terminates in a projection 19 which serves as a stop and determines the length of insertion of the tube piece 6. The helical furrow 20 may be replaced by one or more circumferential grooves.

FIG. 4 shows a connecting fitting 12 in which the opening 18 is surrounded by an annular slot 21. The annular slot 21 is narrow and has the crosssectional configuration of a pointed wedge. The tube piece 6 has a flared end 22, which is pushed into the annular slot 21. Prior to insertion of the tube into the annular slot, the annular slot 21 is filled with the adhesive. When the tube 6 is inserted in the annular slot 21, part of the adhesive collects in a cavity 23 formed at the bottom of the annular slot 21 and part is forced to the side of the annular slot 21.

FIG. 5 shows an arrangement which is especially suitable for application in devices in which several connecting fittings 12 are located in one plane. The connecting fitting 12 has a conical external surface with an annular recess or step 24 on the outside thereof near the end. A conically expanded end of the tube piece 6 is pushed onto the connecting fitting 12, whereby an adhesive pocket 26 is formed by the step 24 between the connecting fitting 12 and the conical end 25 of the tube. A clamping plate 27 with conical bores in which the cones are oriented in the same direction as the cones of the fitting 12, is pushed over the conical ends 25 of the tubes and thereby presses the ends of the tubes against the fittings 12. The adhesive is applied to the conical end 25 of the tube piece 6 prior to pushing the tube onto the fitting and collects in the cavity 26. If desired, additional circumferential grooves may be provided on the outer surface of the fitting 12.

FIG. 6 shows a connecting fitting 12, in which the straight tube piece 6 is inserted into the opening 18. A helical groove 20 which serves to receive the adhesive is located on the wall of the opening. A clamping plate 27 is pushed onto the fitting 12. Clamping plate 27 has a radial shoulder or flange 28 on the end of the bore away from the fitting 12, which surrounds the straight tube piece 6. Between the flange 28 and the outermost end of the fitting 12, a cavity 29 is formed, in which the adhesive collects as the plate 27 is pushed onto the fitting 12.

FIG. 7 shows an evaporator comprising a connecting box 1 and an evaporator core 2. The evaporator core 2 comprises several fork tubes 31, 32 and 33 and the ribs 7 fastened to them. In contrast to the arrangement described in FIG. 1, the connecting box 1 is equipped with a bottom 34. Connecting box 1 and bottom 34 are provided on their abutting surfaces with a plurality of projections 35 and 44 and with corresponding recesses, whereby several tongue and groove joints are formed. Between the bottom 34 and the channels 11, two openings 36 are provided extending transversely to the channels 11, each opening containing a finger 37 of an insert. Reversing channels 38 are formed in each of the fingers 37, each connecting two fittings 39 and 40 or 41 and 42. The fork tube 31 is secured with one end in fitting 12 and with the other end in fitting 39. The fork tube 32 leads from fitting 40 to fitting 41, and fork tube 33 opens into fittings 42 and 13. Fork tubes 31, 32 and 33 are fastened in the fittings on the bottom 34 by flaring the tube ends, resulting in a strong pressure between the fork tubes and the bottom 34. Subsequently, the mating sides of bottom 34 and connecting box 1 are coated with an adhesive, and bottom 34 and connecting box 1 are fitted to each other so that the projections 35 engage the corresponding recesses 43 in connecting box 1.

Figure 8:
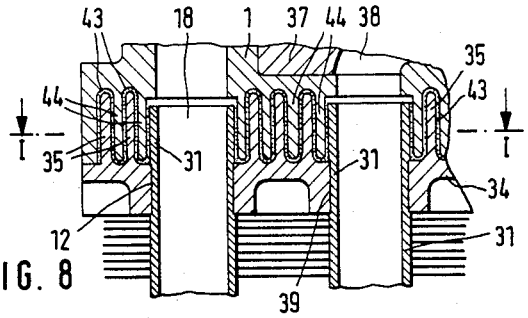
FIG. 8 is an enlarged representation of the detail Y of FIG. 7.

FIG. 8 is an enlarged detail view of area Y of FIG. 7. As clearly seen in the figure, the fork tube 31 is solidly frictionally joined to fittings 12 and 39 by the flaring of fork tube 31. The projections 35 of bottom 34 engage the recesses 43 between projections 44 of the connecting box 1 and thereby form a plurality of interlocking tongue and groove joints and, at the same time, increase the area of the joining surface. Prior to joining the connecting box 1 to bottom 34, the joint surfaces are coated with an adhesive. As the connecting box and the bottom are pushed together, the adhesive is pressed into all of the gaps and cavities located between the parts 1 and 34 and fork tube 31, through the labyrinth-like system of channels. In this manner, a strong joint between connecting box 1 and bottom 34 is obtained, together with good sealing to prevent escape of the coolant.

Figure 9:
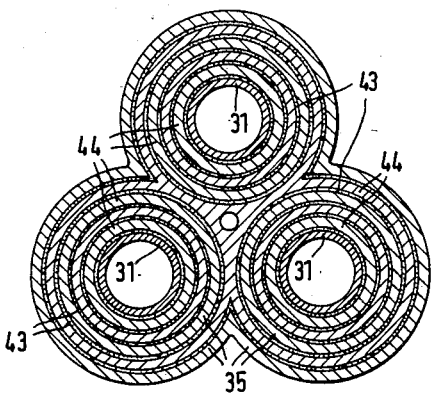
FIG. 9 is a sectional view taken along line I—I of FIG. 8.

FIG. 9 is a cross-sectional view taken along line I—I of FIG. 8. It can be seen that the projections 35 and the recesses 43 are arranged in an annular manner around each of the connecting fittings 12 and 39 and around the ends of fork tube 31. Each of the fittings and each of the fork tubes is thus surrounded by a plurality of interlocking annular projections 35 and 44, with the projections 35 resting in the recesses 43 between the projections 44 of the connecting box 1. Not only is good sealing in the outward direction obtained in this manner, but passage of coolant from the fork tube of one evaporator tube to the fork tube of another evaporator tube is prevented.

In FIG. 10, a section of a joint between evaporator core 2 and connecting box 1 is shown, in which the connecting box 1 is provided with reversing channels 38 by the finger 37 of an insert in which the channels are formed. Like the arrangement illustrated in FIG. 4, the fittings 12 and 39 are each surrounded by an annular slot 21, into which the flared ends 22 of a fork tube 31 are inserted. The part 12' of the fitting 12 which is located radially outward of the flared end 22 has several slits 45 distributed around its circumference, whereby the resilience of the external part 12' is increased. A clamping plate 27 with a plurality of conical openings is pressed onto the connecting fittings 12, whereby a strong pressure fit is obtained between the parts 12, 22 and 12'. Prior to inserting the flared ends 22 into the annular slots 21, the slots are filled with an adhesive. Satisfactory coolant tightness is achieved as a result of the adhesive.

FIG. 11 is a cross-sectional view taken along line II—II of FIG. 10. It can be seen that the fittings 12 and 39 each have an external annular part 12' and 39', which is provided with slits 45 distributed around the circumference of the fitting. A flared end 22 of a fork tube is held between the tube fitting 12 and the outer annular part 12', and another between the tube fitting 39 and the outer annular part 39', by the pressure generated by the clamping plate 27. The line X—X indicates the section shown in FIG. 10.

FIG. 12 is a sectional view of a joint arrangement for a connecting box, bottom and fork tubes. The bottom comprises a metal plate 46 and a synthetic resin part 47, each provided with aligned openings for receiving the fork tubes 31. The synthetic resin plate 47 is provided with several pegs 48 which protrude through the bores 49 of the metal plate 46 into openings 50 in the connecting box 1. The ends of the fork tube 31 are secured to the metal plate 46 by flaring, and the free ends of the fork tubes extend into the connecting box 1. Annular spaces 51 are formed between the connecting box 1 and the ends of the fork tubes. Openings 50 and spaces 51 are filled with an adhesive, after the assembly of the plates 46, 47, and the fork tubes which are attached thereto with the connecting box 1, said adhesive having been coated on the joining surfaces prior to assembly. By means of the adhesive, the pegs 48 and thus the plates 46 and 47 are joined to the connecting box 1, while satisfactory sealing of the coolant is simultaneously achieved by the adhesive in the annular spaces 51.

FIG. 13 is a sectional view taken along line III—III of FIG. 12. It can be seen that by means of a plurality of openings 50 in the connecting box 1 and the pegs 48 of the synthetic resin plate disposed in the openings 50, good adhesive bonding, and thus adequate mechanical strength, is obtained between the connecting box 1 and the plates 46 and 47. The line IV—IV indicates the section shown in FIG. 12.

FIG. 14 shows a joint arrangement in which fork tube 31 is fastened to a metal plate 46 by spreading or flaring. Metal plate 46 is connected to a synthetic resin bottom by a plurality of snap-on elements 53. Connecting box 1 has several annular projections 44 on its side facing the synthetic resin bottom 52 which engage recesses in the synthetic resin bottom 52. At the outer margin of connecting box 1, the plastic bottom 52 is fastened by means of a spring lock 54 which engages a projection 55 on connecting box 1. During the assembly operation, fork tube 31 is initially secured to the metal plate 46 by flaring; the metal plate already having been secured to the synthetic resin bottom 52. Adhesive is thereafter applied to the joining surfaces between the connecting box 1 and parts 31, 46, 52, and synthetic resin bottom 52 is fastened to connecting box 1 by means of spring lock 54. The presence of the adhesive in the joint between the connecting box 1 and the synthetic resin bottom 52 as well as at the ends of the fork tubes, results in good coolant sealing in the outward direction and between the individual connecting fittings.

FIG. 15 shows a section taken along the line V—V of FIG. 14. The reference numerals used therein correspond to those used in FIG. 14. The line VI—VI indicates the section shown in FIG. 14.

FIG. 16 depicts a joint arrangement in which the bottom plate 56 is connected directly to the connecting box 1. Connecting box 1 and bottom plate 56 together form a plurality of integrated reversing channels 38 into which an end of each of fork tubes 31 and 32 open. Bottom plate 56 has a flange-like projection 51 which engages a corresponding, flange-like recess in connecting box 1. At the outer margin of the connecting box several bores are provided to receive rivets 58 which in turn are part of bottom plate 56. Prior to assembly of bottom plate 56 to connecting box 1, fork tubes 31 and 32 are initially fastened to the bottom plate by flaring, and adhesive is applied to the joint area between the parts 1 and 56. After connecting box 1 and bottom plate 56 are pressed together, a rivet joint is established at the margin of the connecting box 1 by rivets 58.

In FIG. 17 a joint between a two-part bottom and a connecting box 1 is shown. In the illustrated arrangement, a mechanical connection between the bottom and the connecting box is effected by a plurality of locking elements. Connecting box 1 is provided with connecting fittings 12 and 13, collecting chamber 14 and integral reversing channel 38. Several locking elements 61, 62 and 63 are arranged on the fittings 12 and 13 and between the reversing channels 38. The aforementioned locking elements are engaged by correspondingly shaped, mating locking elements 64, 65 and 66 on bottom plate 59. Bottom plate 59 has a metal core 60, with fork tubes 31, 32 and 33 inserted in bores in the metal core. Prior to assembly of bottom plate 59 with connecting box 1, the corresponding locking connections and contact surfaces, together with the adhesive pockets 67 formed between the bottom plate and the tube ends, are provided with an adhesive, so that in addition to mechanical fastening, a reliable sealing of the coolant is obtained.

FIG. 18 shows a section taken along line VII—VII of FIG. 17. It can be seen that each of the fittings 12 and 13 and each reversing channel 38 is surrounded by a tongue and groove joint. The reference numerals correspond to those used in FIG. 17.

The arrangements described above are not restricted to use as heat exchangers (evaporator or condenser) of air conditioning or refrigerating devices. The invention is also suitable for other uses including use in heat exchangers with low-viscosity fluid coolants capable of penetrating through joints which are not supplementarily sealed.

The foregoing description has been set forth merely to illustrate the invention and is not intended to be limiting. Since modifications of the disclosed embodiments incorporating the spirit and substance of the invention may occur to persons skilled in the art, the scope of the invention is to be limited solely with respect to the appended claims and equivalents.

What is claimed is:

1. An arrangement sealingly joining tubes of a heat exchanger core to a connecting box, wherein said connecting box comprises a bottom with cylindrical openings through which the ends of the tubes extend, and the tubes are spread in said openings and joined to said bottom in said openings in a press fit, wherein at least one space is provided inside the connecting box surrounding each tube, each said space comprising a cavity bounded by the connecting box bottom and the tube and being filled with adhesive material, and wherein said bottom is joined to said connecting box in a joint area and has a plurality of projections annularly surrounding each tube end, said projections engaging recesses in the connecting box to form a plurality of tongue and groove joints in the joint area between the connecting box and the bottom.

* * * * *